US006109700A

United States Patent [19]

Branson et al.

[11] Patent Number: 6,109,700

[45] Date of Patent: Aug. 29, 2000

[54] MINE ROOF BOLTING APPARATUS AND METHOD OF USING THE SAME

[76] Inventors: William B. Branson, Box 1, 94T, Helper, Utah 84526; George L. Ferguson, 138 Grassy Trail P.O. Box 169, East Carbon, Utah 84520; David L. Stokes, P.O. Box 217, Cleveland, Utah 84518; Russel Jensen, P.O. Box 724, Ferron, Utah 84523; Scott H. Timothy, 1460 W. 400 North, Price, Utah 84501

[21] Appl. No.: 09/112,632

[22] Filed: Jul. 9, 1998

(Under 37 CFR 1.47)

Related U.S. Application Data

[60] Provisional application No. 60/053,078, Jul. 9, 1997.

[51] Int. Cl.[7] ..... E21D 12/00

[52] U.S. Cl. ..... 299/33; 299/11

[58] Field of Search ..... 173/25, 27, 31, 173/32, 39; 299/11, 31, 33, 42; 405/303

[56] References Cited

U.S. PATENT DOCUMENTS

| | | | |
|---|---|---|---|
| 3,849,995 | 11/1974 | Jamison | 299/11 X |
| 4,157,878 | 6/1979 | Jamison | 405/303 |
| 4,199,193 | 4/1980 | Damron et al. | 299/31 |
| 4,226,476 | 10/1980 | Fairchild et al. | 299/31 |
| 4,240,665 | 12/1980 | Hubbard et al. | 299/31 |
| 4,256,186 | 3/1981 | Barthe et al. | 173/189 |
| 4,297,057 | 10/1981 | O'Neil | 405/303 |
| 4,389,072 | 6/1983 | Linke et al. | 299/32 |
| 4,395,163 | 7/1983 | Perraud | 405/303 |
| 4,595,316 | 6/1986 | Tinnel | 405/291 |
| 4,640,369 | 2/1987 | Goyarts | 173/42 |
| 4,832,536 | 5/1989 | Spross et al. | 405/303 |
| 4,934,758 | 6/1990 | Walters | 299/43 |
| 5,050,934 | 9/1991 | Brandl et al. | 299/33 |

FOREIGN PATENT DOCUMENTS

| | | |
|---|---|---|
| 836045 | 8/1983 | South Africa . |

OTHER PUBLICATIONS

"ARO Rapid Face Bolting Machines" Brochure by Hydramatic Engineering Pty Ltd, undated.

"S4000 Roofbolter ARO: Hydramatic Engineering—Series 4000 Roofbolter" Brochure, undated.

"2RFB–1 ARO: Hydramatic Engineering—Rapid Face Bolter for Longwalls" Brochure, undated.

*Primary Examiner*—Eileen Dunn Lillis
*Assistant Examiner*—Sunil Singh
*Attorney, Agent, or Firm*—Stoel Rives LLP

[57] ABSTRACT

A modular roof bolting apparatus adapted to be installed on a face conveyor track of longwall mining equipment. A roof drilling assembly is rotationally mounted on a platform to an operating position and an installation position. The roof bolting drill is mounted to the platform so that in the lowered position the roof bolting drill lies parallel to an elongate axis of the platform. This arrangement provides a low-profile arrangement that allows the roof bolting apparatus to be installed in areas where space is limited. For example, the roof bolting apparatus can be lifted over either the headgate or tailgate drive without having to disassemble them.

4 Claims, 5 Drawing Sheets

MINE ROOF BOLTING APPARATUS AND METHOD OF USING THE SAME

This application claims the benefit of the earlier filed U.S. provisional patent application Ser. No. 60/053,078 filed Jul 9, 1997.

TECHNICAL FIELD

The present invention is directed to mine roof bolting machines for use in a longwall mining operation and, more particularly, to a modular mine roof bolting machine that is compact and comparatively light weight to allow maneuvering and installation of the roof bolting machine onto a longwall face conveyor track in areas of limited space.

BACKGROUND OF THE INVENTION

Longwall mining involves the removal of coal from a single longwall face, generally 80–200 m in length. The coal is extracted by a cutter, for example, a rotary drum shearer that is attached to the front of the longwall conveyor frame and runs on a flexible segmented rail typically referred to as the face conveyor track. The face conveyor track extends along the length of the working area. The extracted coal is passed on to a flexible conveyor located immediately behind the face conveyor track. The coal is then conveyed to a transfer point located in one of the access headings, for example, the headgate at the side of the longwall panel.

The mine roof along the working area is protected by moveable hydraulic roof supports, such as shields, chocks, or other supports. As more coal is extracted, these roof supports are moved forward. The roof supports are typically located behind the pan line of the longwall conveyor frame and are attached to, but can be moved independently of, the longwall conveyor frame. The roof behind the line is allowed to collapse as the line moves forward. The longwall conveyor frame is advanced by hydraulic cylinders located adjacent the roof support structures behind the pan line. When the cutter has completed a pass, the roof supports are advanced independently of the longwall conveyor frame. Once the roof supports have been advanced the required distance, the longwall conveyor frame is then advanced so that at no time is the face conveyor track exposed to an unsupported roof.

After a complete block of coal is mined, it is necessary to disassemble the longwall conveyor frame, including the roof supports, and move the equipment to a new face. Because the roof supports extend out over the conveyor, there is insufficient space to disassemble and remove the roof supports if they are located too close to the longwall face. Therefore, the roof supports are typically not advanced during the last few passes of the cutter into the longwall face. Advancing the cutter and conveyor without advancing the roof supports; however, leaves an unsupported roof area at the longwall face.

Some conditions require the roof to be supported; therefore, the roof must be bolted after each pass of the cutter to avoid collapse. Typically, stopers are used to manually drill bolt holes in the mine roof along the longwall face after the roof supports stop advancing. Because the roof supports are not advanced, the stoper operators must install temporary supports and are unprotected from falling roof material during such installation.

Although hydraulic roof bolting machines are known, such machines are extremely bulky and heavy and require a great deal of space for maneuvering and installation along a longwall face. Such machines are acceptable where there is plenty of space for maneuvering large equipment. However, in situations where space is limited such prior roof bolting machines are impractical. In order to install such large roof bolting machines it would be necessary to shut down and disassemble either the headgate or tailgate drive after each cut, attach the roof bolting machine to the face conveyor track, reassemble the headgate or tailgate drive, and then make an additional cut. This procedure is very time consuming and labor intensive.

SUMMARY OF THE INVENTION

The present invention is directed to a mine roof bolting apparatus that is compact and comparatively light weight to allow maneuvering and installation onto a longwall face conveyor track in areas of limited space. Installation of the roof bolting apparatus onto the face conveyor track can be accomplished without shutting down and disassembling either the headgate or tailgate drive.

It is an object of the invention to provide a roof bolting machine that is compact and relatively light weight.

Another object of the invention is to provide a roof bolting apparatus that is capable of being maneuvered and installed onto a longwall conveyor frame in areas of limited space.

Still another object of the invention is to provide a roof bolting apparatus that reduces risks incurred in manual roof bolting operations.

A further object of the invention is to provide a roof bolting apparatus that can be installed onto a longwall conveyor frame without shutting down and/or disassembly of the headgate or tailgate drive.

The present invention provides a roof bolting apparatus adapted to be installed on a face conveyor track of longwall mining equipment. The roof bolting apparatus comprises a platform that overlies the face conveyor track and is mounted thereto to be driven along the face conveyor track. The platform is driven by a single drive sprocket that engages a haulage mechanism, such as a chain, extending the length of the face conveyor track. The platform is stabilized by trapping shoes that engage the face conveyor track.

A roof drilling assembly is rotationally mounted to the platform for movement to a raised operating position and a lowered installation position. The roof drilling assembly is mounted to the platform so that in the lowered position the roof bolting drill lies parallel to the axis of the platform. This arrangement provides a low-profile arrangement that allows the assembly to be installed in areas where space is limited. For example, the assembly can be lifted over either the headgate or tailgate drive without having to disassemble them. The roof drilling assembly is mounted on the platform by a slide plate operable by a cylinder to move the roof drilling assembly toward and away from the mining face.

Additional objects and advantages of this invention will be apparent from the following detailed description of preferred embodiments thereof which proceeds with reference to the accompanying drawings.

DETAILED DESCRIPTION OF PREFERRED EMBODIMENT

Longwall mining equipment generally comprises a cutter (not shown) that is advanced along a flexible segmented rail typically referred to as the face conveyor track. The face conveyor track is adjacent to a working face of coal 10 (FIG. 1) and extends along the length of the working face 10 so that the cutter removes coal as it travels the length of the face conveyor track. The cutter and other equipment are powered by drives at each end of the longwall mining frame generally referred to as the headgate and tailgate drives. These drives are typically large and bulky and take up a large amount of space. The roof bolting apparatus of the present invention is adapted to be installed on the face conveyor track of a longwall mining apparatus and to utilize various aspects of the longwall apparatus, such as its haulage mechanism and hydraulic system. The roof bolting apparatus is constructed and arranged so that it can be easily installed onto the face conveyor track in areas of limited space without having to disassemble either the headgate or tailgate drive.

Figure 1:
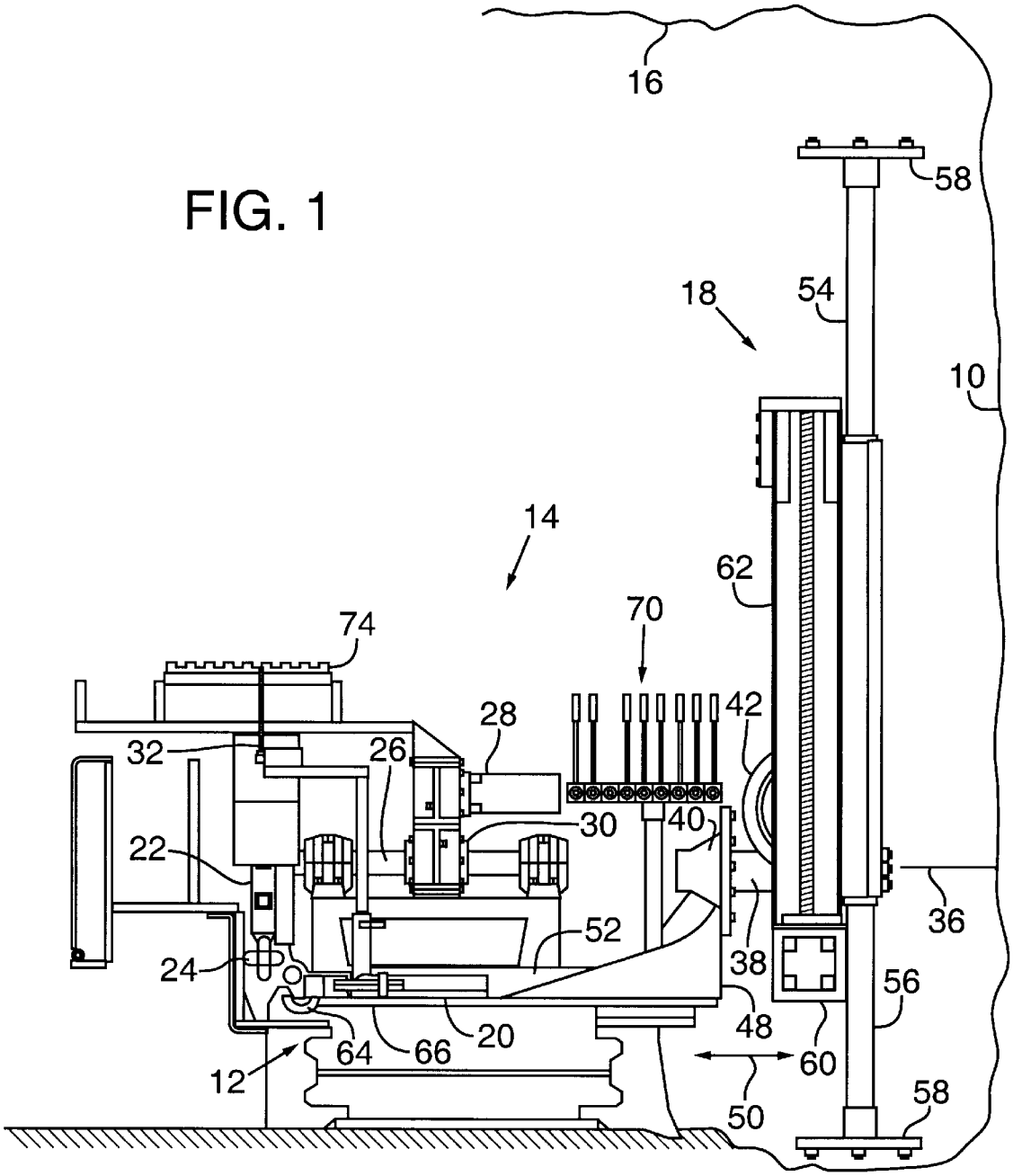
FIG. 1 is an end view of the roof bolting apparatus of the present invention shown installed onto a face conveyor track of a longwall mining apparatus.
Figure 2:
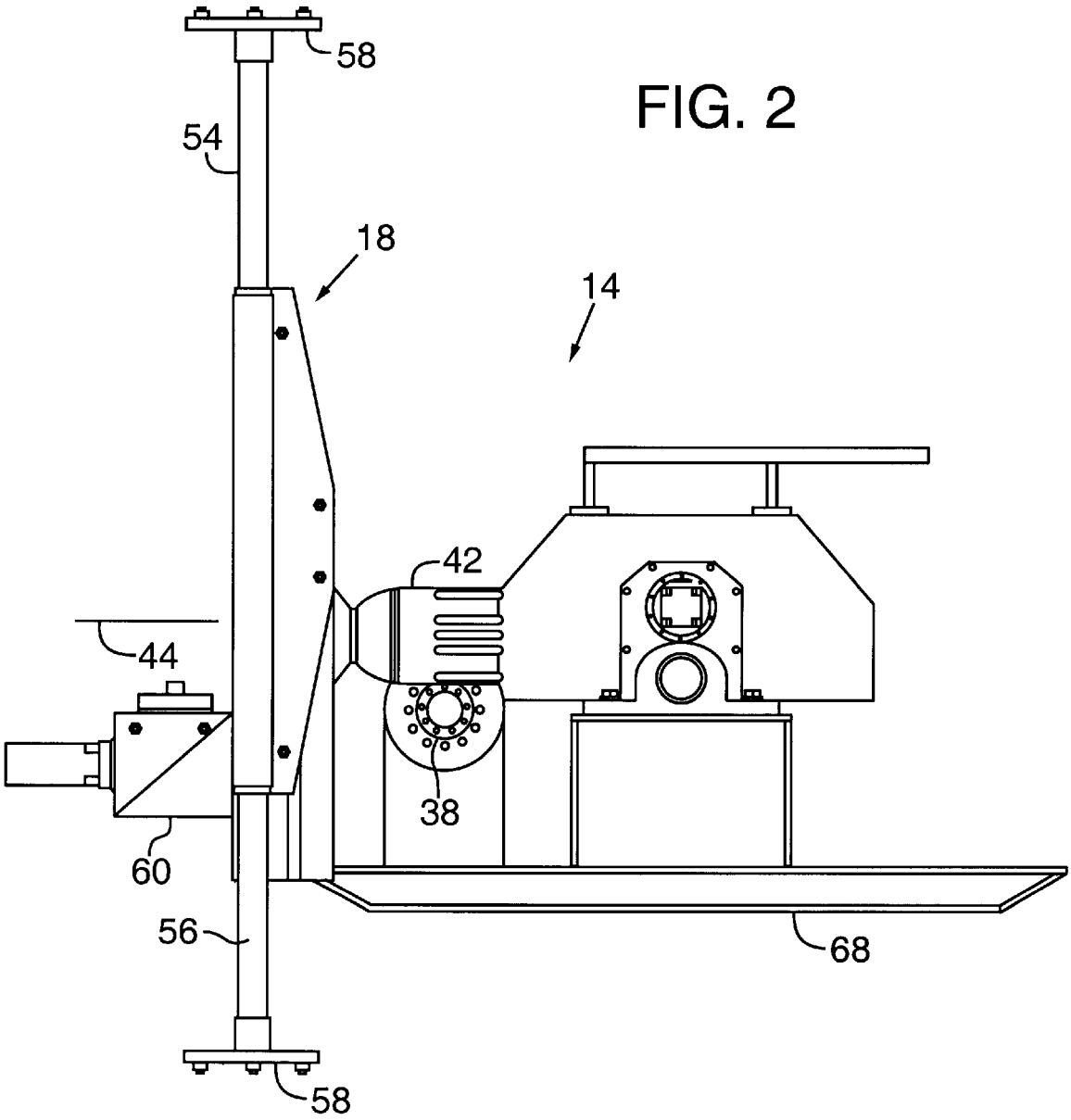
FIG. 2 is a front view of the roof bolting apparatus of FIG. 1.
Figure 3:
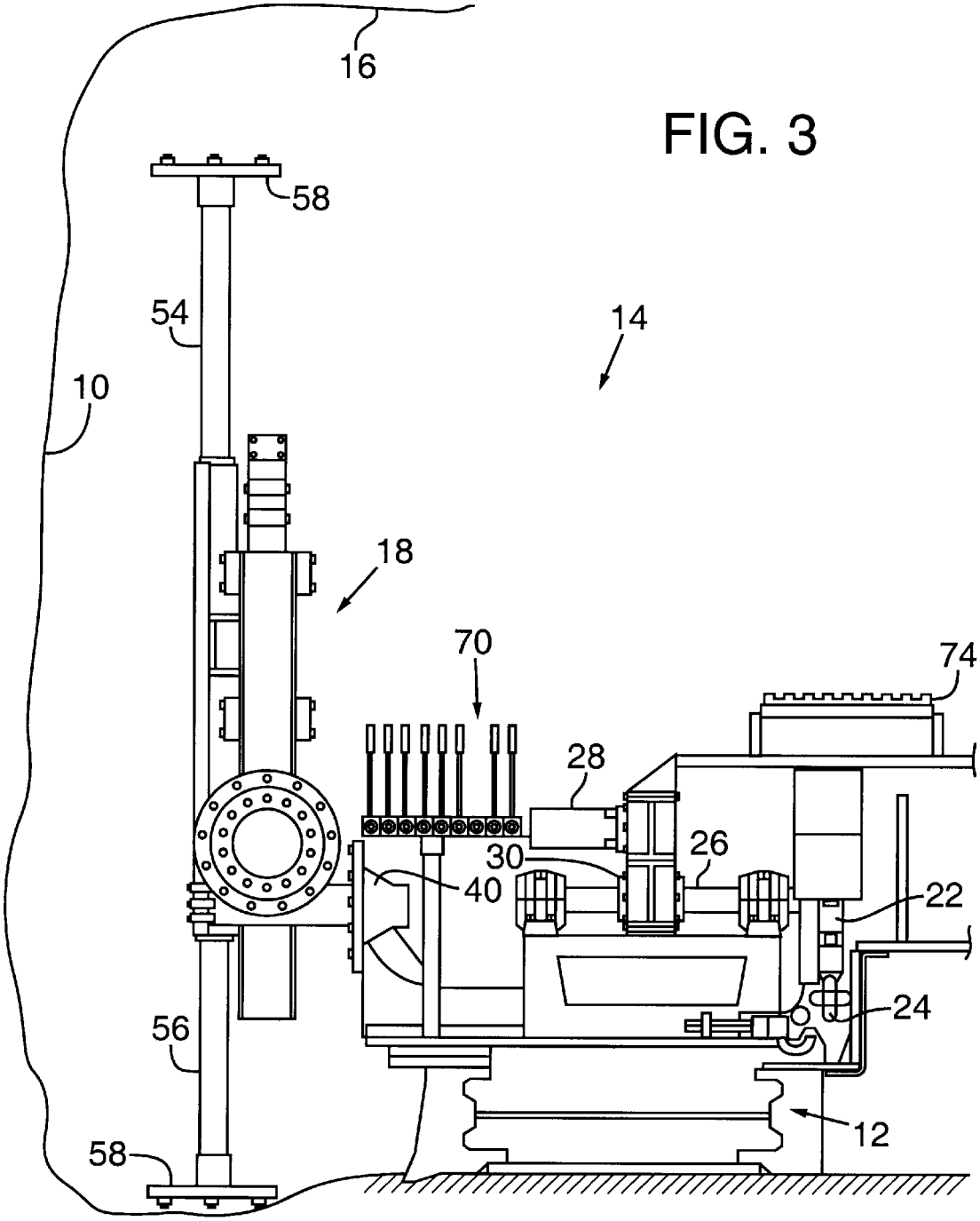
FIG. 3 is an end view showing the end opposite that shown in FIG. 1.

FIGS. 1–3 show a face conveyor track 12 of a longwall mining apparatus with the roof bolting apparatus 14 of the present invention installed thereon. The roof bolting apparatus 14 is shown in a raised position where it is located between the face conveyor track 12 and the longwall mining face 10. The roof bolting apparatus 14 is driven along the face conveyor track 12 which runs parallel to the longwall mining face 10 to drill holes in the mine roof 16 for the roof bolts to secure the mine roof 16. Typical longwall mining equipment includes roof supports (not shown) that extend over and just past the face conveyor track 12 leaving an unsupported area between the roof supports and the longwall mine face 10. It is the purpose of the roof bolting apparatus 14 to provide an automated method of supporting the mine roof 16 without exposing workers to an unsupported mine roof and a potentially hazardous condition.

The roof bolting apparatus 14 includes a roof drilling assembly 18 mounted on a platform 20. The platform 20 is mounted on the face conveyor track 12 and is advanced along the face conveyor track 12 by a drive sprocket 22 that engages a haulage mechanism shown as a chain 24 that extends the length of the face conveyor track 12. The drive sprocket 22 is rotated by a shaft 26 driven by a drive motor 28 through a gear box 30. The drive motor 28 is controlled by a tram control 32 that is accessible from either inside or outside of the pan line. Thus, the tram control 32 operates the drive motor 28 to rotate the drive sprocket 22 to advance the roof bolting apparatus 14 along the longwall face 10. As the drive sprocket 22 is rotated the platform 20 and, thus, the roof bolting assembly 18 is propelled along the face conveyor track 12. The platform 20 extends along an axis 34 (FIG. 2) that is substantially parallel to the face conveyor track 12.

Figure 5:
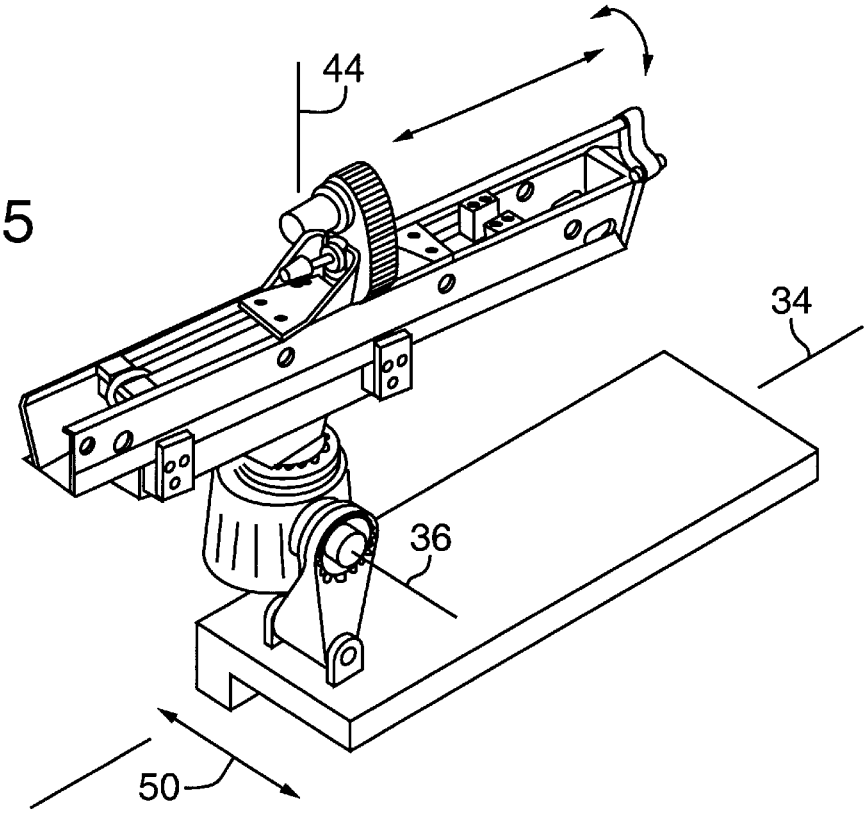
FIG. 5 is a simplified isometric view of the roof drilling apparatus mounted on the platform shown in a retracted position.
Figure 6:
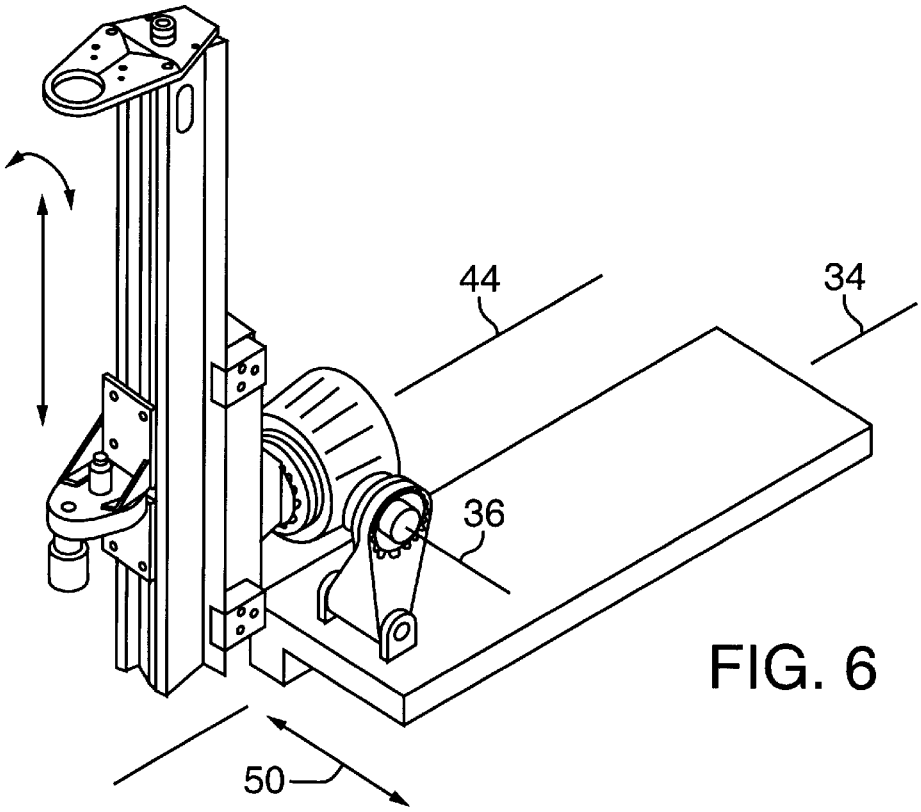
FIG. 6 is a simplified isometric view of the roof drilling apparatus of FIG. 5 shown in an upright operating position.

The roof drilling assembly 18 is mounted to the platform 20 for rotation about a first axis 36 from a lowered position (FIG. 5) in which it is parallel to the axis 34 (FIGS. 5 and 6) of the platform 20 to an upright raised position (FIG. 6) in which the roof drilling assembly 18 can be operable to drill the mine roof 16. The roof drilling assembly 18 is rotated about the first axis 36 by a positioning motor 38 mounted to a fixed support 40 and connected to the roof drilling assembly 18 through a positioning knuckle 42. Therefore, before installation onto the face conveyor track 12 the roof drilling assembly 18 is in the lowered position so that it extends parallel to the axis 34 of the platform 20. This arrangement provides a substantially compact assembly that can be lifted over either the headgate or tailgate drives and installed onto the face conveyor track without having to dismantle either drive.

Once the roof bolting apparatus 14 is installed onto the face conveyor track 12 the roof drilling assembly 18 is rotated about the first axis 36 to the upright position seen in FIGS. 1–3 and FIG. 6 for operation. When the roof drilling assembly 18 is in the upright position it can be rotated about a second axis 44 (FIG. 2) for accurate positioning by another positioning motor located within the positioning knuckle 42. The roof drilling assembly 18 is further connected to a sliding plate 48 (FIG. 1) mounted upon the platform 20. The sliding plate 48 is movable toward and away from the longwall face 10 in the direction of arrows 50 (FIG. 1) by a hydraulic cylinder 52. The cylinder 52 positions the roof drilling assembly 18 between the tip of the roof support shields (not shown) and the longwall face 10.

The roof drilling assembly 18 includes an upper temporary roof support cylinder 54 and a lower stab jack cylinder 56 which are independently operable. Both the upper and lower cylinders 54 and 56 have a flexibly mounted stabilizing plate 58 for engagement with the roof and floor, respectively. Thus, after the roof drilling assembly 18 is raised to the upright position the upper and lower cylinders 52 and 54 are extended to stabilize the roof drilling assembly 18.

Once the roof drilling assembly 18 is in position the drilling operation can begin. The rotary drill head 60 is mounted to reciprocate on a carriage 62 in a manner that is known in the art for drilling in a mine roof. The rotary drill head 60 includes a rotary drive motor that rotates a drill steel (not shown). A chain and cylinder drive are located within the carriage 62 to advance and retract the rotary drill head 60 along the carriage 62. After the roof bolts have been installed at the first location the upper and lower cylinders 54 and 56 are retracted and the roof bolting apparatus 14 is advanced along the face conveyor track 12 to the next location for drilling. The platform 20 includes trapping shoes 64 and adjustable rail guides 66 that cooperate with the face conveyor track 12 to prevent the platform 20 from swiveling about the drive sprocket 22. The platform 20 further includes skies 68 (FIG. 2) that extend the length of the platform 20 which slide along the face conveyor track 12 as the roof bolting apparatus 14 is advanced.

The control bank 70 is located on the platform 20 for controlling the temporary roof support cylinder 54, stab jack cylinder 56, rotary drill head 60, drill feed and the cylinder 52 for the slide plate 48. The control bank 70 is adjustable for ease of access.

Figure 4:
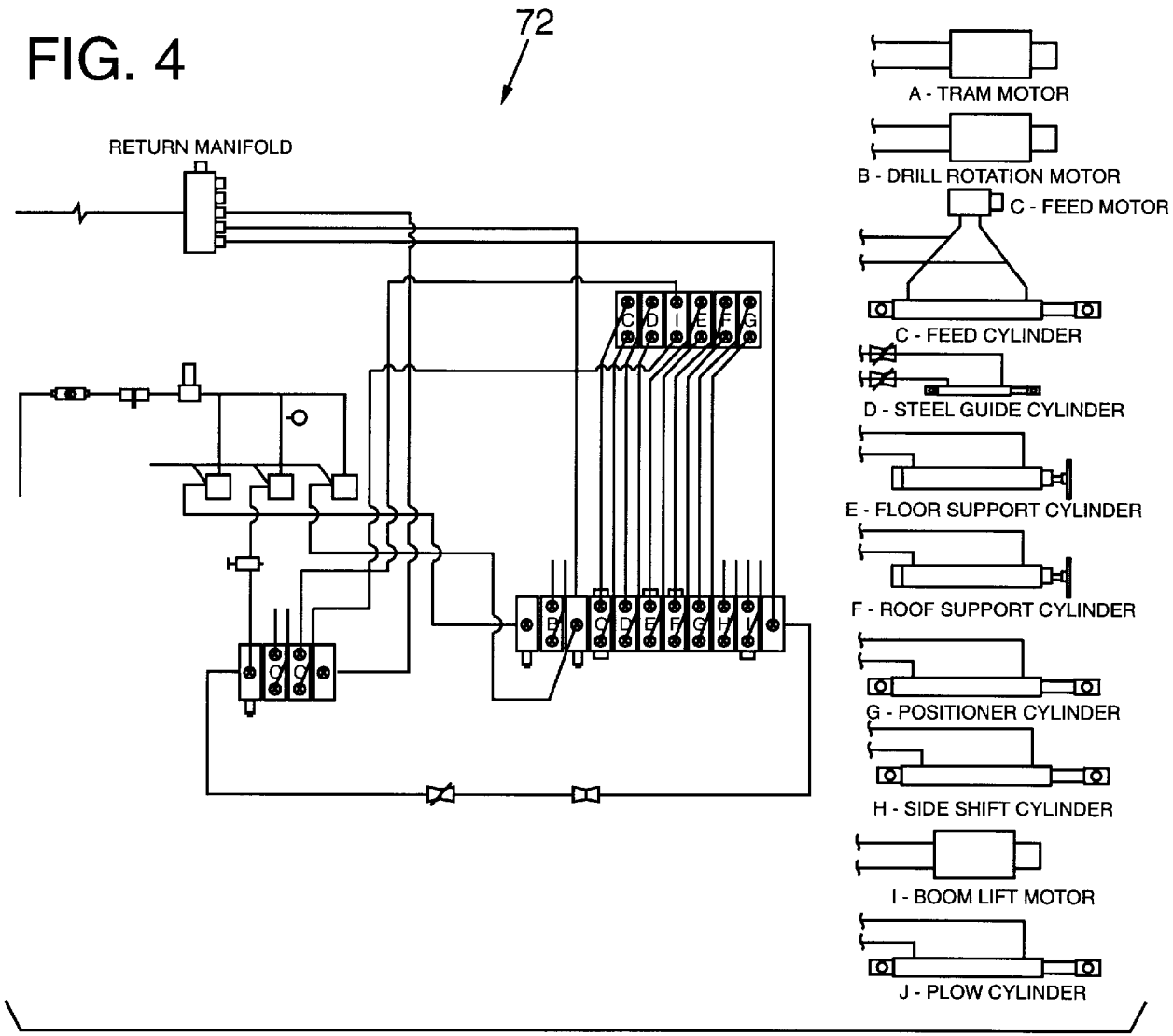
FIG. 4 is a schematic of the hydraulic system used in the present invention.

The roof bolting apparatus 18 of the present runs on 1,250 psi with the control bank 70 running on 2,000 psi, all which run on emulsion which is 95% water and 5% emulsified oil. The emulsion is provided by the longwall mining equipment and is connected thereto by the hydraulic system represented in FIG. 4.

For convenience, a removable drill steel tray 74 is connected to the platform for holding and storing drill steels. Furthermore, a temporary protector device (not shown) may be connected to the platform 20 for the protection of the operator from falling debris.

It will be obvious to those having skill in the art that many changes may be made to the details of the above-described embodiment of this invention without departing from the underlying principles thereof. The scope of the present invention should, therefore, be determined only by the following claims.

What is claimed is:

1. A roof bolting apparatus adapted for mounting on a longwall face conveyor track of a longwall mining apparatus that is substantially parallel to a mining face; comprising:

a platform extending along an axis and having a drive mechanism that is adapted to cooperate with the longwall mining apparatus for propelling the platform along the longwall face conveyor track;

a slide plate mounted on the platform for movement in a direction perpendicular the axis of the platform, the slide plate having a front edge substantially adjacent to the mining face when the platform is installed on the longwall face conveyor track; and a roof drilling assembly mounted on the slide plate to extend over the front edge for rotation about a first axis perpendicular to the axis of the platform from a first position in which the roof drilling assembly is substantially parallel to the axis of the platform to a second position in which the roof drilling assembly is substantially perpendicular to the axis of the platform.

2. The roof bolting apparatus of claim 1 wherein the roof drilling assembly is mounted on the slide plate for rotation about a second axis that is perpendicular to the first axis and that is parallel to the axis of the platform when the roof drilling assembly is in the second position.

3. A roof bolting apparatus adapted for use with a longwall mining apparatus having a face conveyor track on which a cutter mechanism travels along a mining face and having a headgate drive at one end of the longwall mining apparatus and a tailgate drive at an opposite end of the longwall mining apparatus; comprising:

a platform having a drive mechanism that is adapted to cooperate with the longwall mining apparatus for advancing the platform along the face conveyor track wherein the platform extends along an axis substantially parallel to the face conveyor track; and a roof drilling assembly mounted on the platform by a slide plate for movement from a first position in which the roof drilling assembly extends substantially parallel to the axis of the platform to a second position in which the roof drilling assembly extends substantially perpendicular to the axis of the platform, wherein the roof drilling assembly is compact enough in the first position to be installed onto the face conveyor track without disassembly of either the headgate drive or the tailgate drive.

4. A method of installing a roof bolting apparatus onto a face conveyor track of a longwall mining apparatus on which a cutter mechanism travels along a mining face and having a headgate drive at one end of the longwall mining apparatus and a tailgate drive at an opposite end of the longwall mining apparatus; comprising:

providing a platform for traveling along the face conveyor track and extending along an axis with a roof drilling apparatus mounted thereon by a slide plate movable on the platform in a direction perpendicular to the axis of the platform;

positioning the roof drilling apparatus in a first position substantially parallel to the axis of the platform;

locating the roof drilling apparatus onto the face conveyor track so that the roof drilling apparatus can be propelled along the face conveyor track without having to disassemble either the headgate drive or the tailgate drive; and positioning the roof drilling apparatus in a second position substantially perpendicular to the axis of the platform.

* * * * *